US009166353B1

(12) United States Patent
Doornbos

(10) Patent No.: US 9,166,353 B1
(45) Date of Patent: Oct. 20, 2015

(54) LARGE FERRULE CRIMP DIE

(71) Applicant: Panduit Corp., Tinley Park, IL (US)

(72) Inventor: Simon L. Doornbos, Plainfield, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/490,771

(22) Filed: Sep. 19, 2014

(51) Int. Cl.
*H01R 43/048* (2006.01)
*B21D 37/10* (2006.01)

(52) U.S. Cl.
CPC ..... *H01R 43/048* (2013.01); *B21D 37/10* (2013.01)

(58) Field of Classification Search
CPC ..... H01R 43/048; B21D 37/10
See application file for complete search history.

(56) References Cited

U.S. PATENT DOCUMENTS

| | | | | |
|---|---|---|---|---|
| 455,694 | A | 7/1891 | Steltz | |
| 3,146,519 | A | 9/1964 | Redwine | |
| 3,412,596 | A | 11/1968 | Burns | |
| 3,585,704 | A | 6/1971 | Schroeder | |
| 4,261,194 | A | 4/1981 | Stephens | |
| 4,292,833 | A * | 10/1981 | Lapp | 72/416 |
| 5,187,968 | A | 2/1993 | Beetz et al. | |
| 5,775,158 | A * | 7/1998 | Hensley et al. | 72/325 |
| 5,884,540 | A | 3/1999 | Mo | |
| 6,101,862 | A * | 8/2000 | Rzasa et al. | 72/413 |
| 6,227,030 | B1 | 5/2001 | Lefavour et al. | |
| 6,272,738 | B1 | 8/2001 | Holliday et al. | |
| 6,324,884 | B1 | 12/2001 | Barjesteh et al. | |
| 6,792,789 | B1 | 9/2004 | Faucher | |
| 7,143,626 | B2 | 12/2006 | Dole | |
| 7,165,436 | B2 | 1/2007 | Bitz | |
| 7,237,426 | B2 | 7/2007 | Baker et al. | |
| 7,409,847 | B2 | 8/2008 | Wightman et al. | |
| 8,001,822 | B2 * | 8/2011 | Chadbourne | 72/416 |
| 2013/0042460 | A1 | 2/2013 | Frenken | |

FOREIGN PATENT DOCUMENTS

| | | | |
|---|---|---|---|
| FR | 2777819 | A1 | 10/1999 |

* cited by examiner

*Primary Examiner* — David B Jones
(74) *Attorney, Agent, or Firm* — Christopher S. Clancy; Aimee E. McVady

(57) ABSTRACT

The present invention is directed to a crimp die used to deform a ferrule onto a cable. The crimp die operates within multiple tool platforms. The crimp die includes a male die, a female die, and removable tab adapters. The male and female dies each have a mounting portion and an inner crimping surface to deform the ferrule onto the cable. When required by the tool platform, the tab adapters are removably affixed to the male and female dies to secure the dies to the tool.

13 Claims, 22 Drawing Sheets

LARGE FERRULE CRIMP DIE

Field of the Invention

The present invention relates to crimp dies, and more particularly to a large ferrule crimp die that operates within multiple tool platforms.

BACKGROUND OF THE INVENTION

Crimp dies are used to install ferrules onto stranded cables. Crimp dies also prepare the cables and ferrule to fit into a lug. Typically a crimp die is chosen based on the ferrule, cables, and the installation or crimping tool. As a result, a number of crimp dies are manufactured for various crimping tools. Maintaining a plurality of crimp dies for various crimping tools is costly. Thus, it is desirable to provide one set of crimp dies that operate within multiple tool platforms.

SUMMARY OF THE INVENTION

The present invention is directed to a crimp die that operates within multiple tool platforms. The crimp die is designed to crimp a large ferrule onto a cable. The crimp die includes a male die and a female die. Each die has a mounting portion and an inner crimping surface. The inner crimping surfaces of the male and female dies deform the ferrule onto the cable. The crimp die also includes at least one tab adapter removably affixed to the male die or the female die.

DETAILED DESCRIPTION

Figure 1:
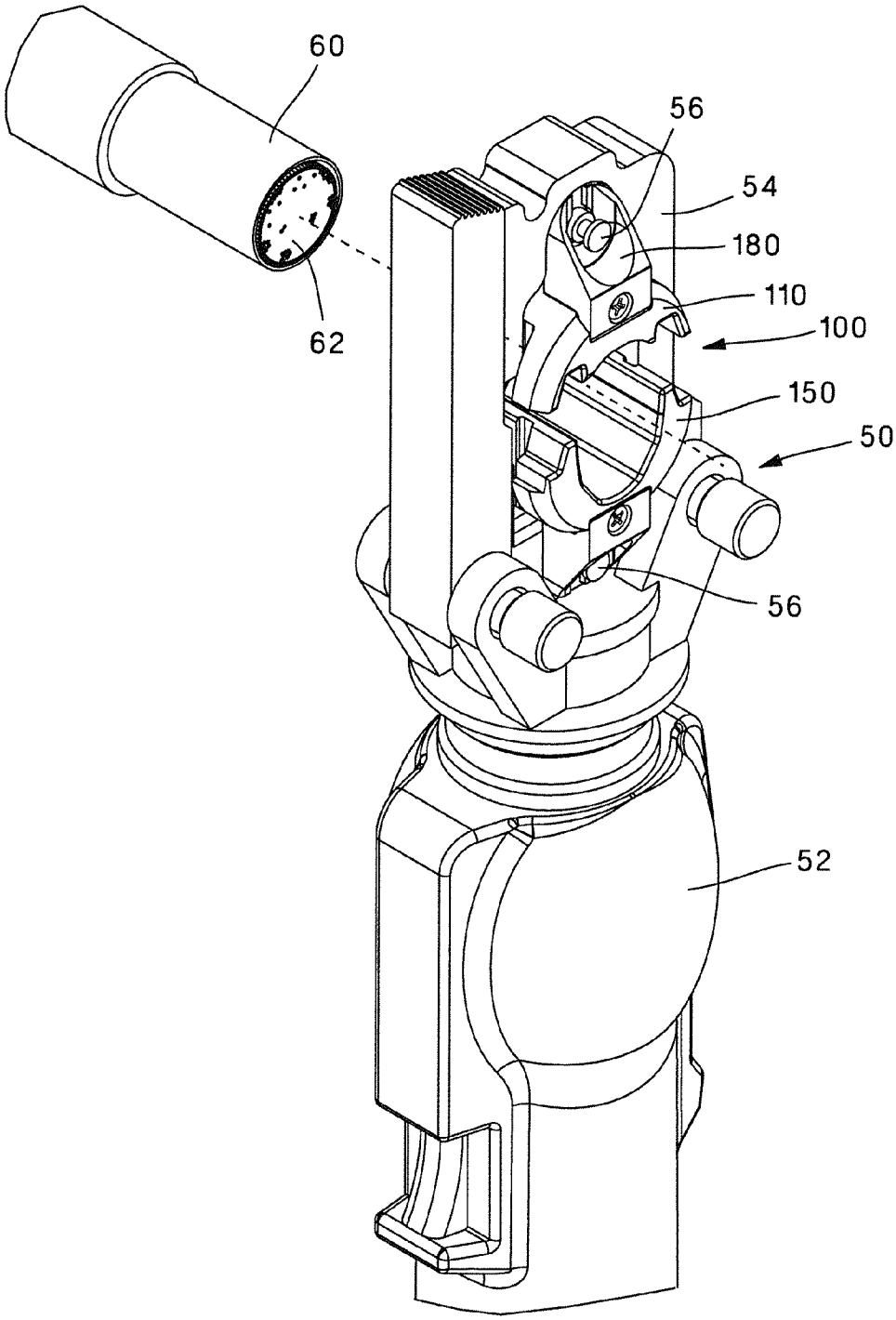
FIG. 1 illustrates a perspective view of one embodiment of the large ferrule crimp die installed in a crimping tool with a ferrule positioned around cables to be crimped.
Figure 2:
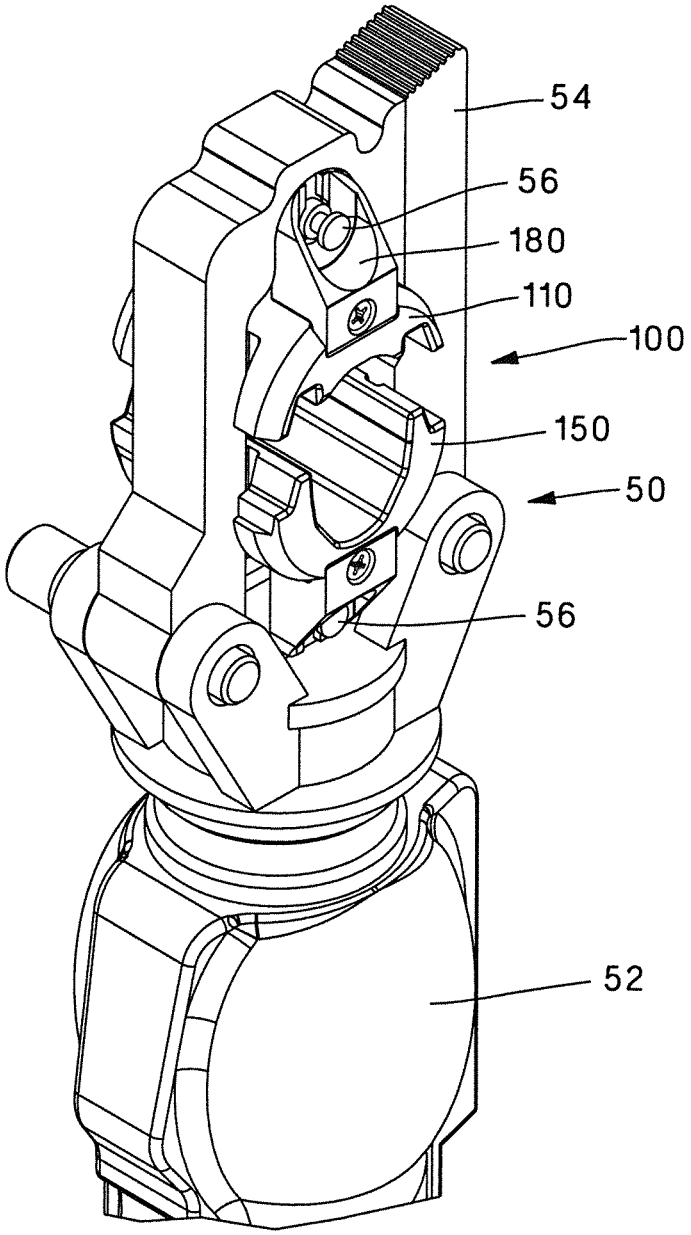
FIG. 2 illustrates a perspective view of the large ferrule crimp die of FIG. 1 installed in the tool.
Figure 3:
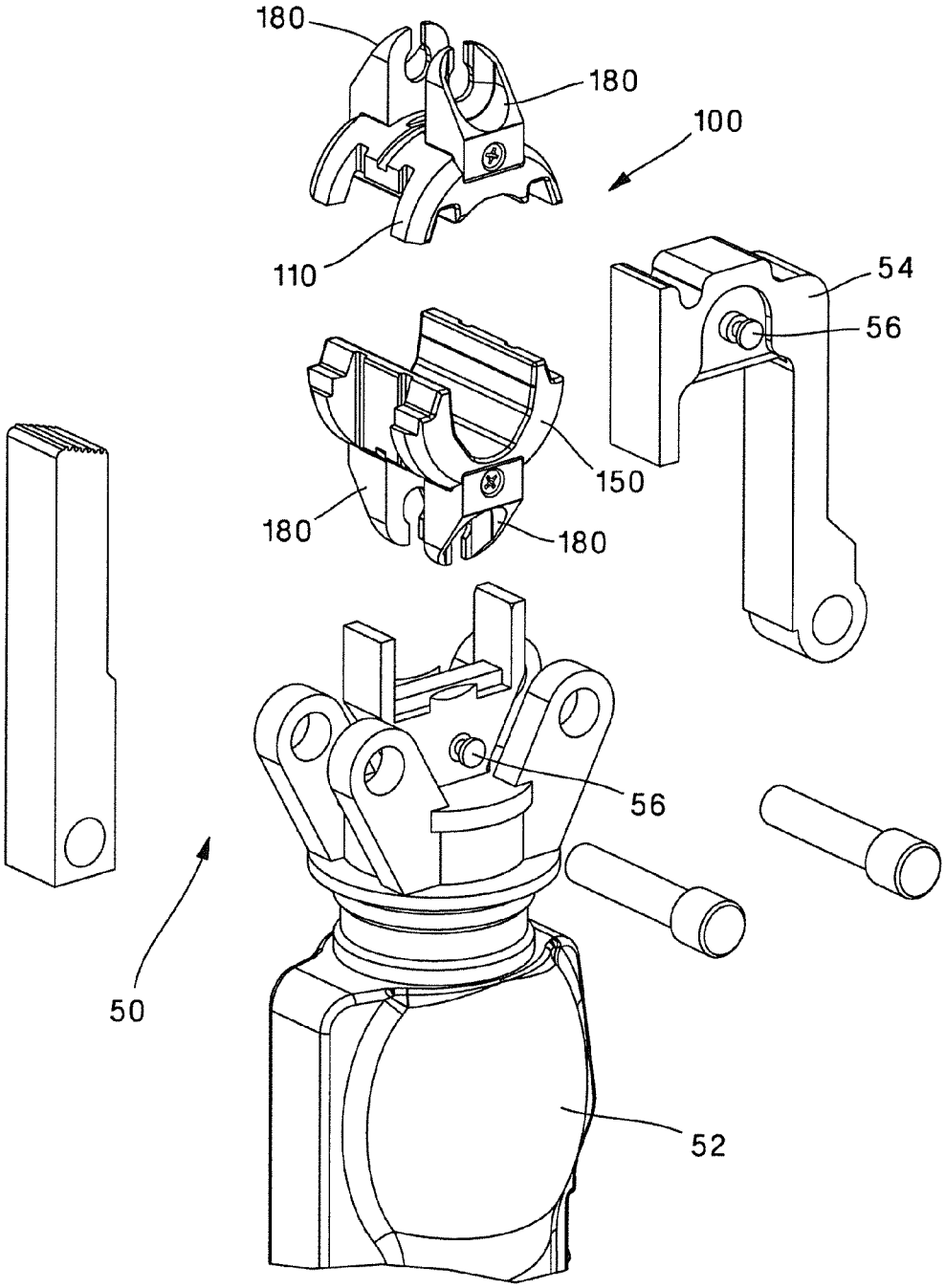
FIG. 3 illustrates a partially exploded view of the large ferrule crimp die and the tool of FIG. 1.

FIGS. 1 and 2 illustrate an embodiment of the large ferrule crimp die 100 installed in a crimping tool 50. The crimping tool 50 is an example of a crimping tool that receives the large ferrule crimp die of the present invention. The crimping tool 50 is sold by Panduit Corp., assignee of the present invention, with a CT-2000 series or a CT-3000 series tool head. This style crimping tool is used for portability and on-site installation. FIG. 3 illustrates a partially exploded view of the large ferrule crimp die 100 and the crimping tool 50.

Figure 4:
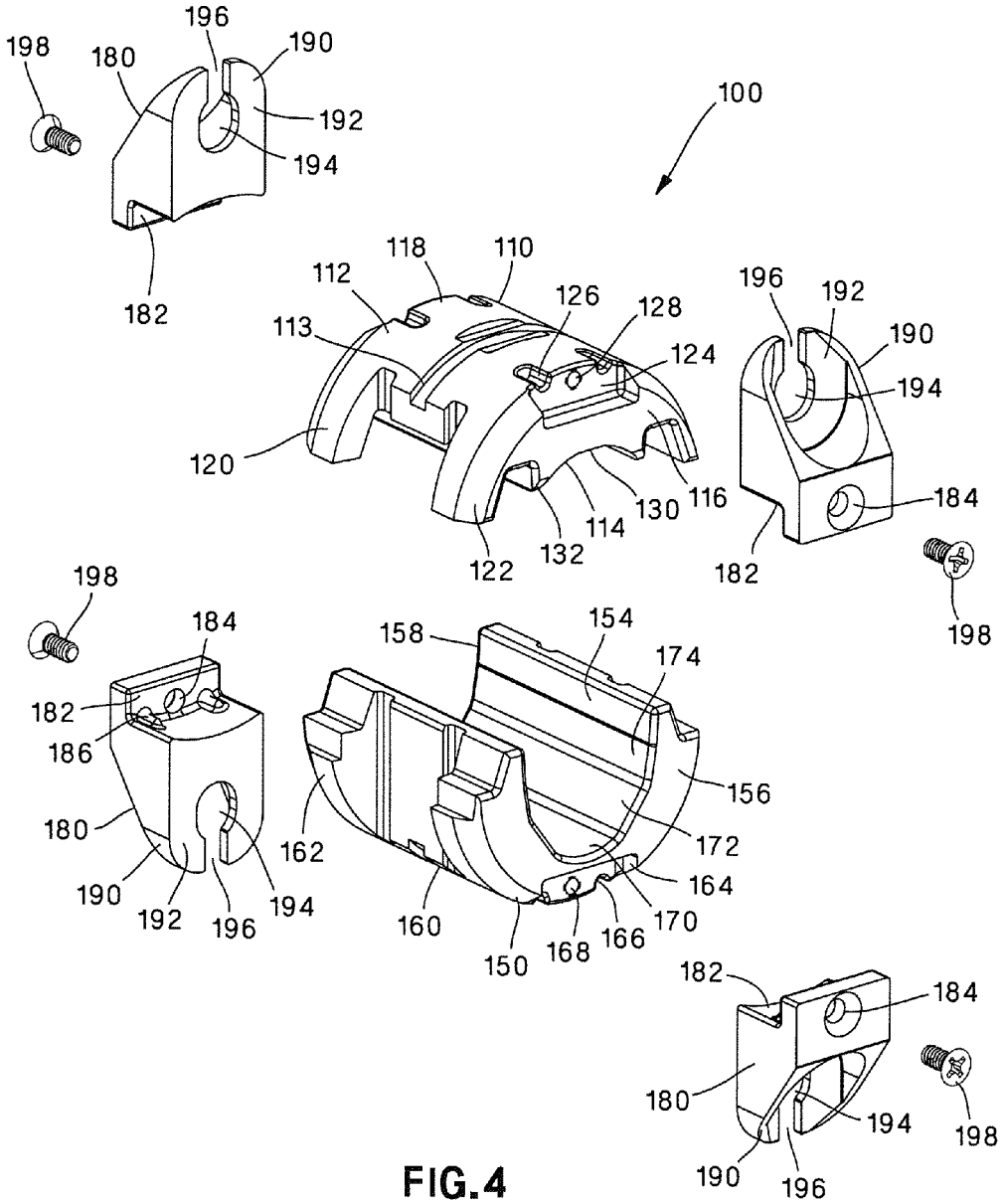
FIG. 4 illustrates a top exploded view of the large ferrule crimp die of FIG. 3.
Figure 5:
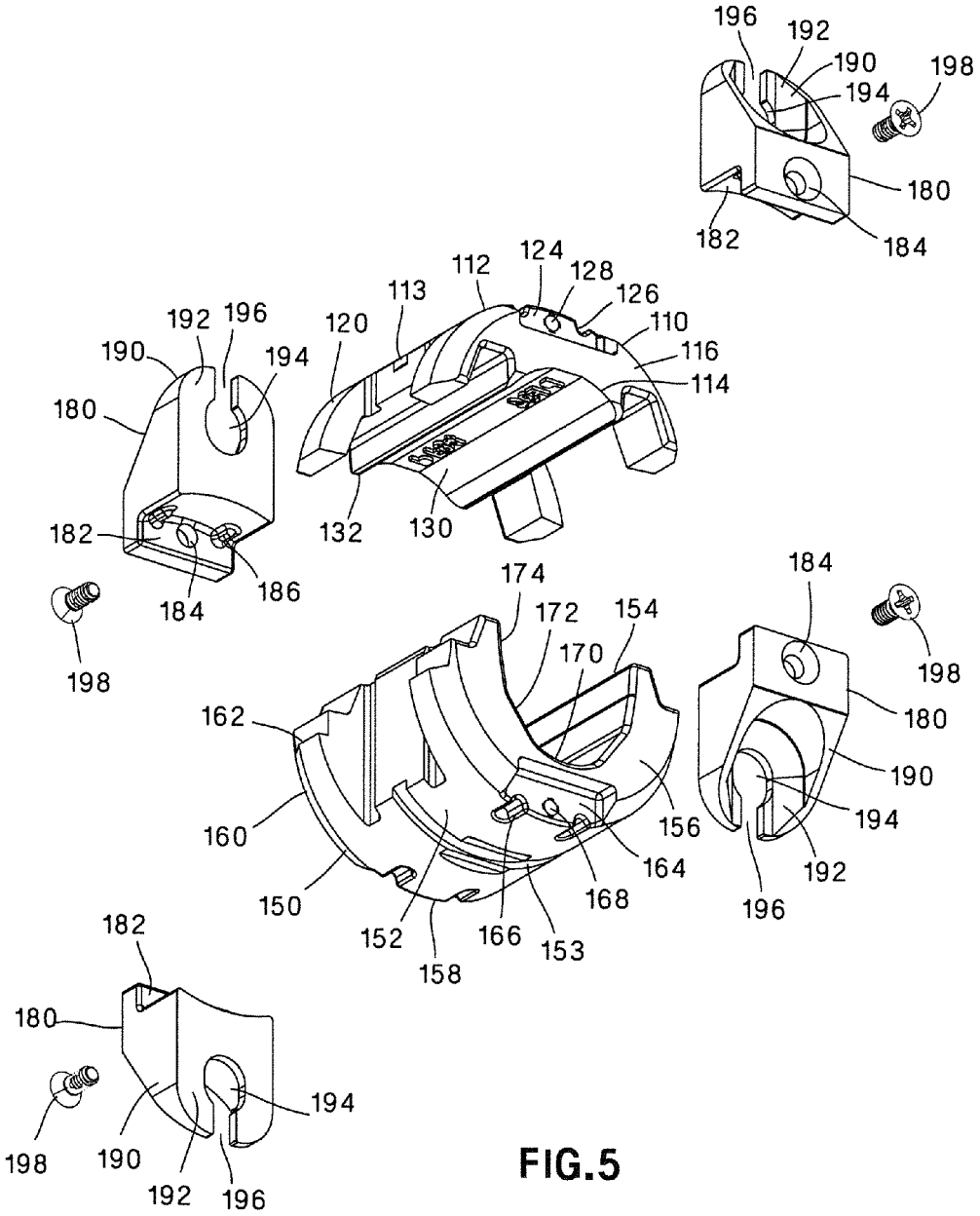
FIG. 5 illustrates a bottom exploded view of the large ferrule crimp die of FIG. 3.
Figure 6:
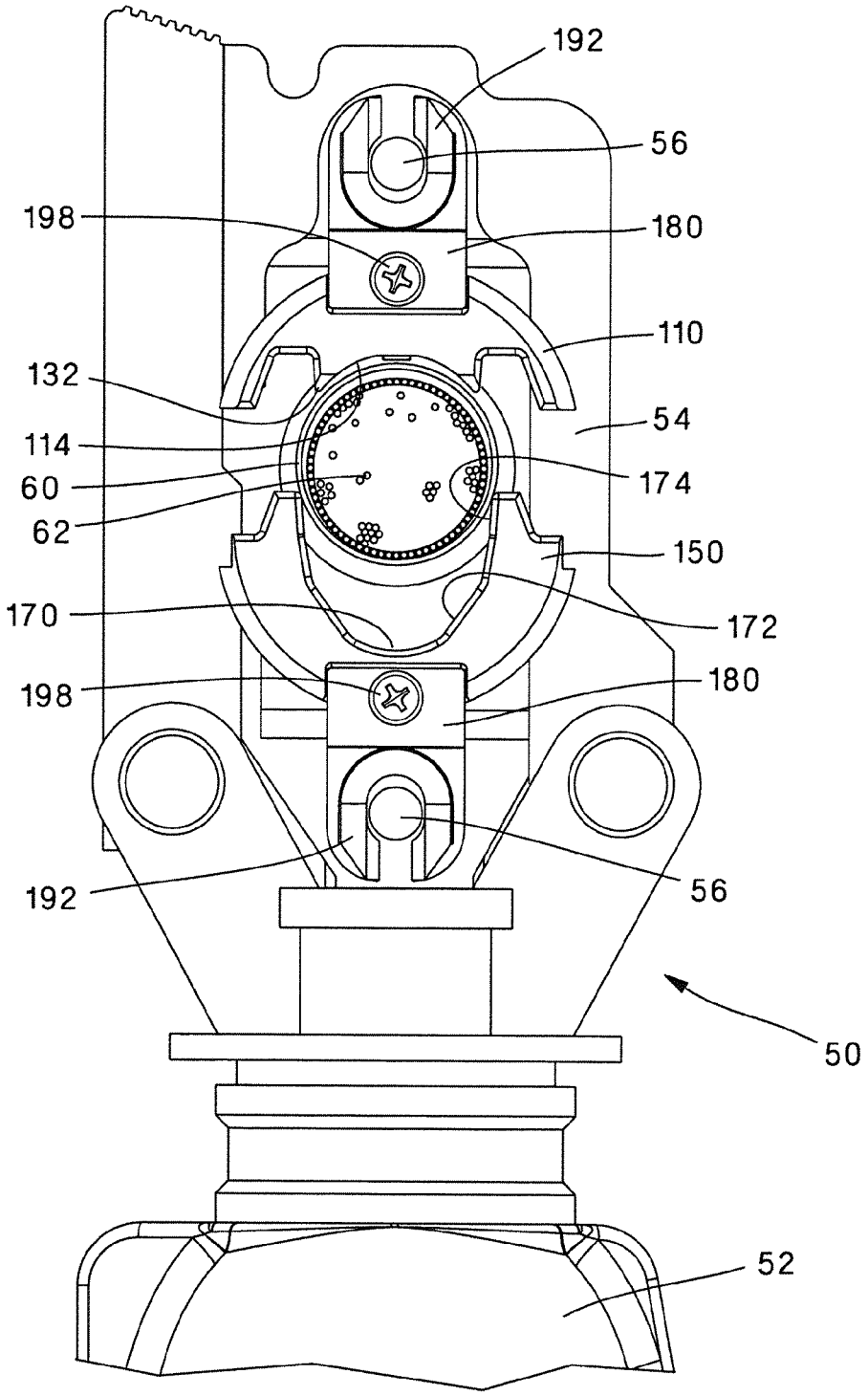
FIG. 6 illustrates a front view of the ferrule positioned in the large ferrule crimp die of the tool of FIG. 1.
Figure 7:
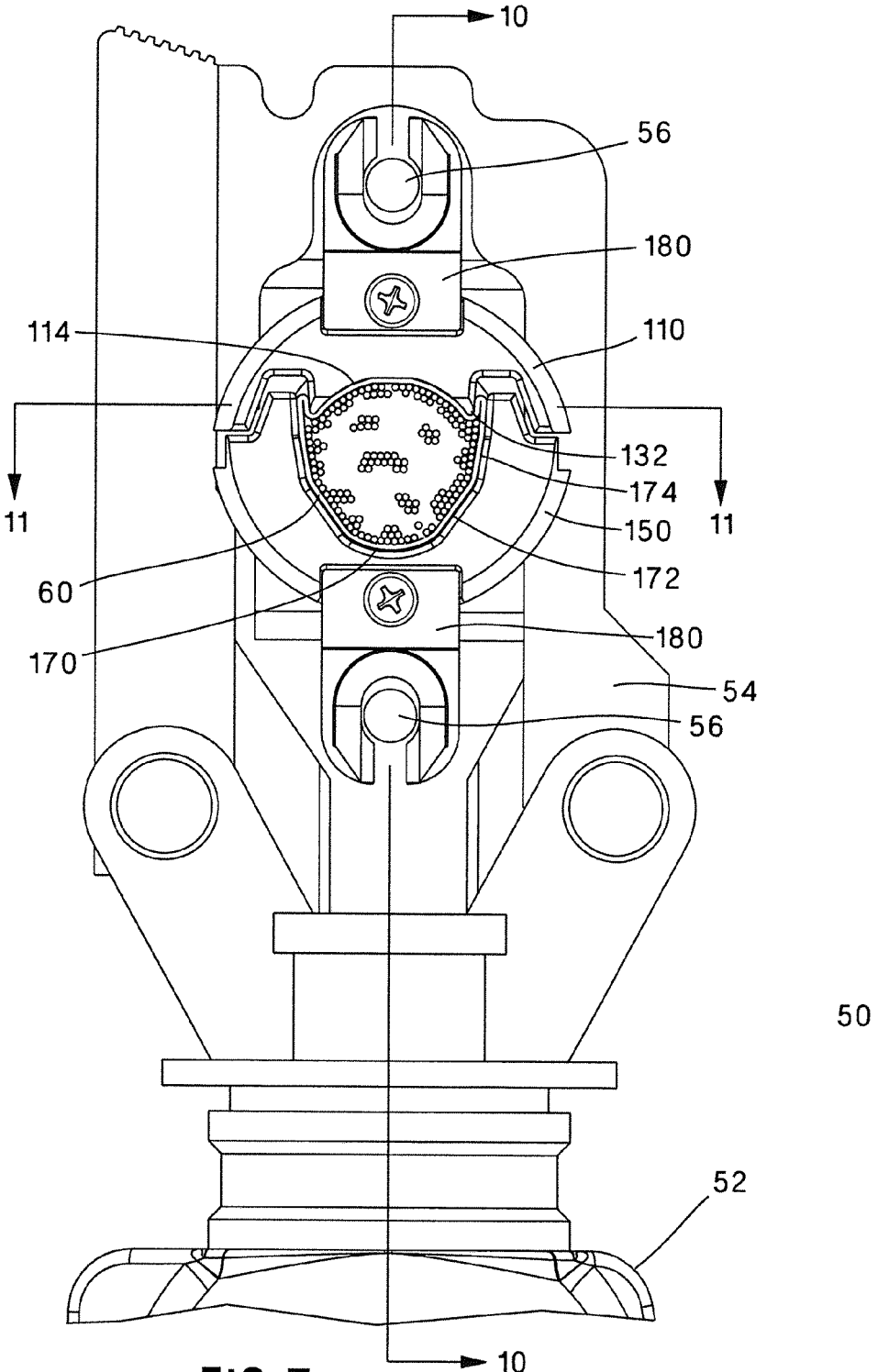
FIG. 7 illustrates a front view of a crimped ferrule positioned in the large ferrule crimp die of FIG. 6.

As illustrated in FIGS. 4 and 5, the large ferrule crimp die 100 includes a male die 110, a female die 150, and a plurality of tab adapters 180. The male die 110 includes a mounting portion 112 and an inner crimping surface 114. The mounting portion 112 includes a center groove 113 along the outer side of the male die 110. The front 116 and back 118 of the mounting portion 112 of the male die 110 include a pocket 124 with grooves 126 and a hole 128 centered between the grooves 126. Each pocket 124 has a generally rectangular shape; however, it is contemplated that each pocket may be formed in other shapes that correspond to the shape of the tab adapters 180.

The female die 150 includes a mounting portion 152 and an inner crimping surface 154. The mounting portion 152 includes a center groove 153 along the outer side of the female die 150. The front 156 and back 158 of the mounting portion 152 of the female die 150 include a pocket 164 with grooves 166 and a hole 168 centered between the grooves 166. Each pocket 164 has a generally rectangular shape; however, it is contemplated that each pocket may be formed in other shapes that correspond to the shape of the tab adapters 180.

The sides 120, 160 of the male die 110 and the female die 150, respectively, include a side edge 122, 162 for engaging the tool head 54.

The inner crimping surface 114 of the male die 110 includes a circular portion 130 that leads to two raised members 132. The inner crimping surface 154 of the female die 150 includes a curved portion 170 that leads to angled portions 172 and then vertical portions 174.

The tab adapters 180 of the large ferrule crimp die 100 have a generally L-shaped bottom portion 182. The L-shaped bottom portion 182 includes a hole 184 and two extrusions 186. Each tab adapter 180 is positioned in one of the pockets 124, 164 of the male die 110 or the female die 150, respectively. The extrusions 186 of the tab adapter 180 are positioned in the grooves 126, 166 in the pockets 124, 164. The hole 184 in the tab adapter 180 aligns with one of the holes 128, 168 in the pocket 124, 164 for receiving a fastener 198, such as a screw. Fasteners 198 secure each tab adapter 180 to the front 116 and back 118 of the male die 110 and the front 156 and back 158 of the female die 150.

The tab adapters 180 also include a mounting portion 190 for securing the tab adapter 180 and attached male die 110 or female die 150 to the crimping tool 50. Each mounting portion 190 includes two legs 192 with a center opening 194 or aperture therebetween. The center opening 194 is designed with a narrow entrance end 196 to enable the tab adapter 180 to snap onto the pins 56 on the crimping tool 50.

Figure 8:
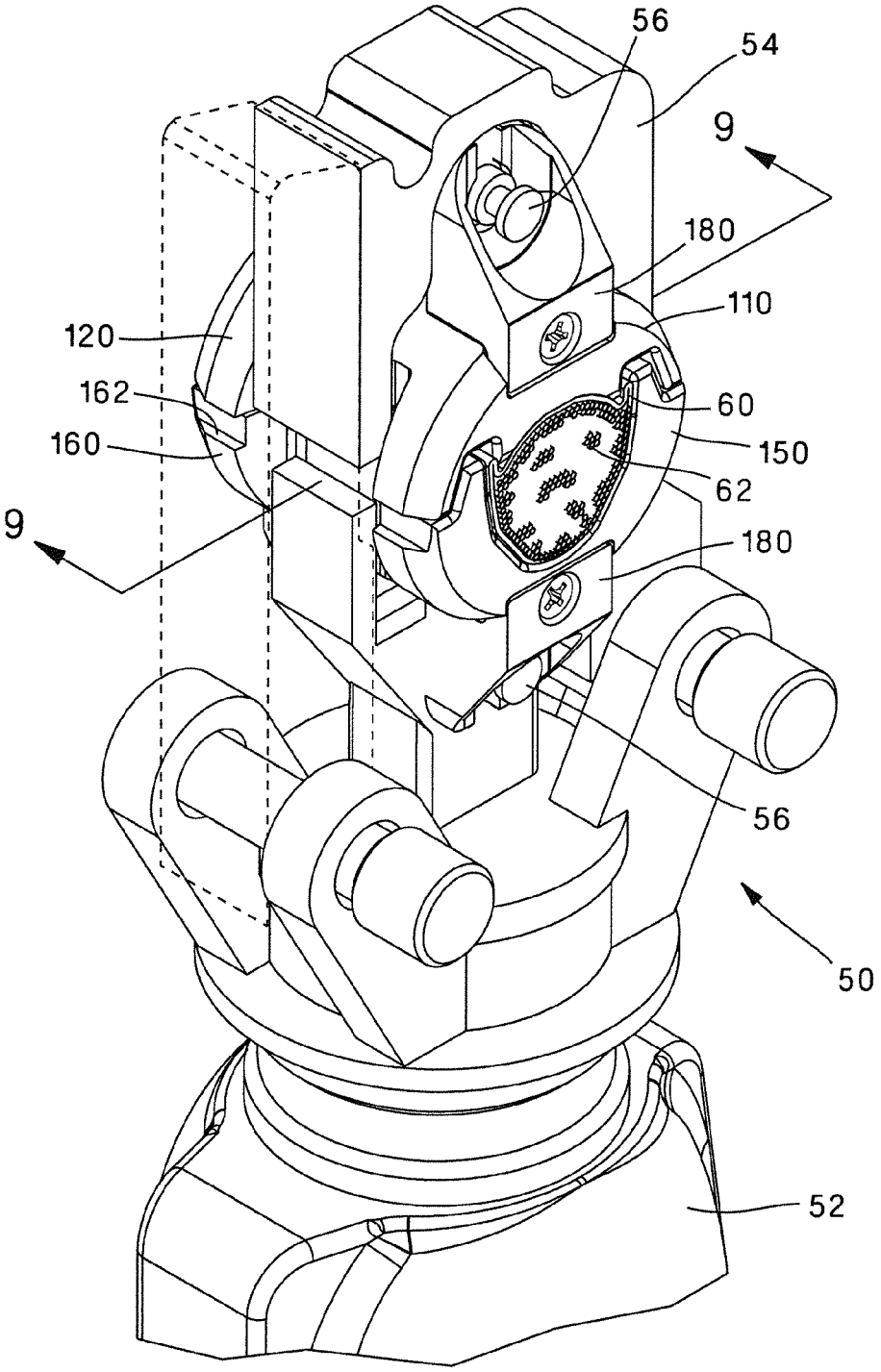
FIG. 8 illustrates a front perspective view of the crimped ferrule positioned in the large ferrule crimp die of FIG. 7.
Figure 9:
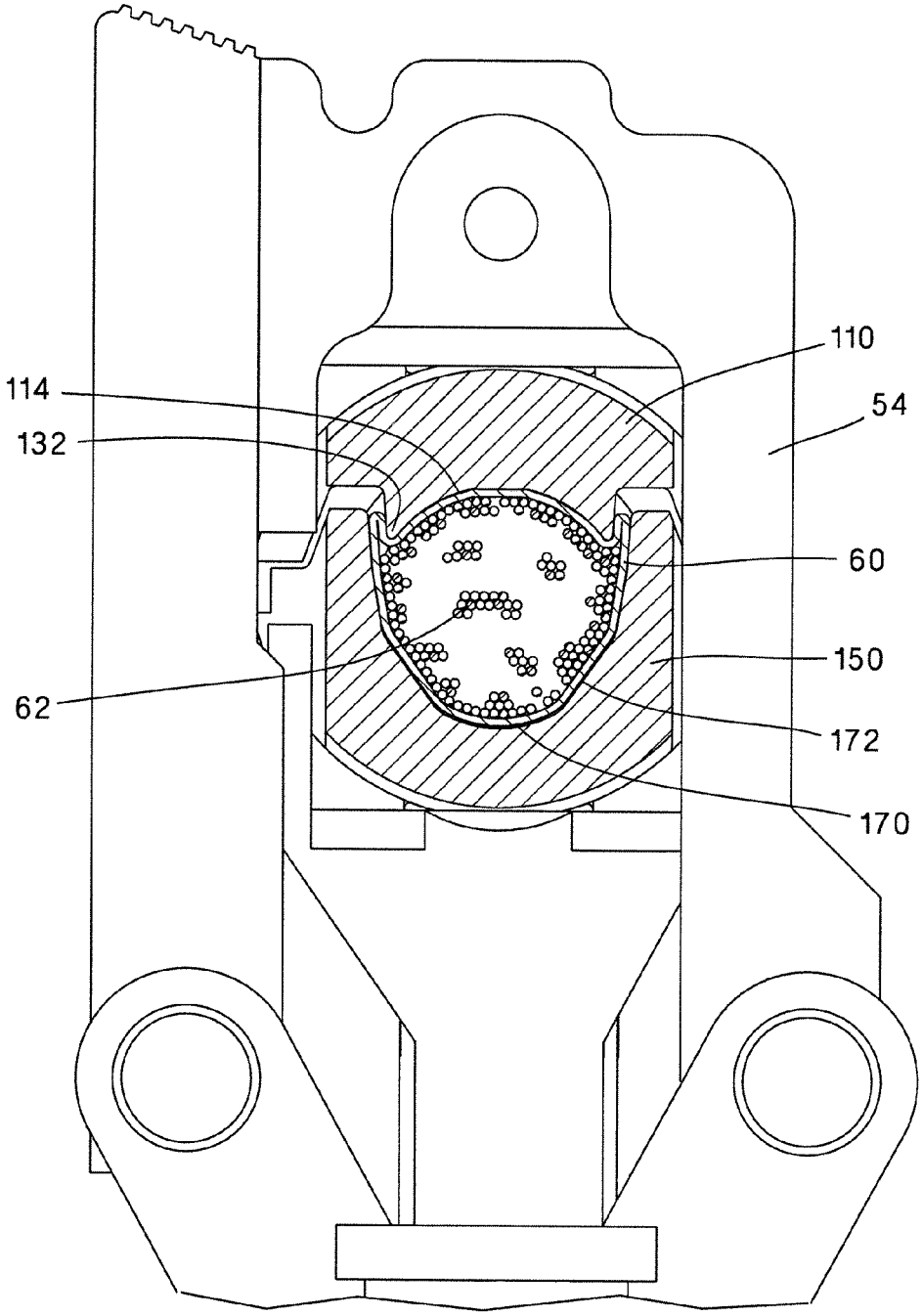
FIG. 9 illustrates a cross sectional view of the large ferrule crimp die and the tool taken along line 9-9 of FIG. 8.
Figure 10:
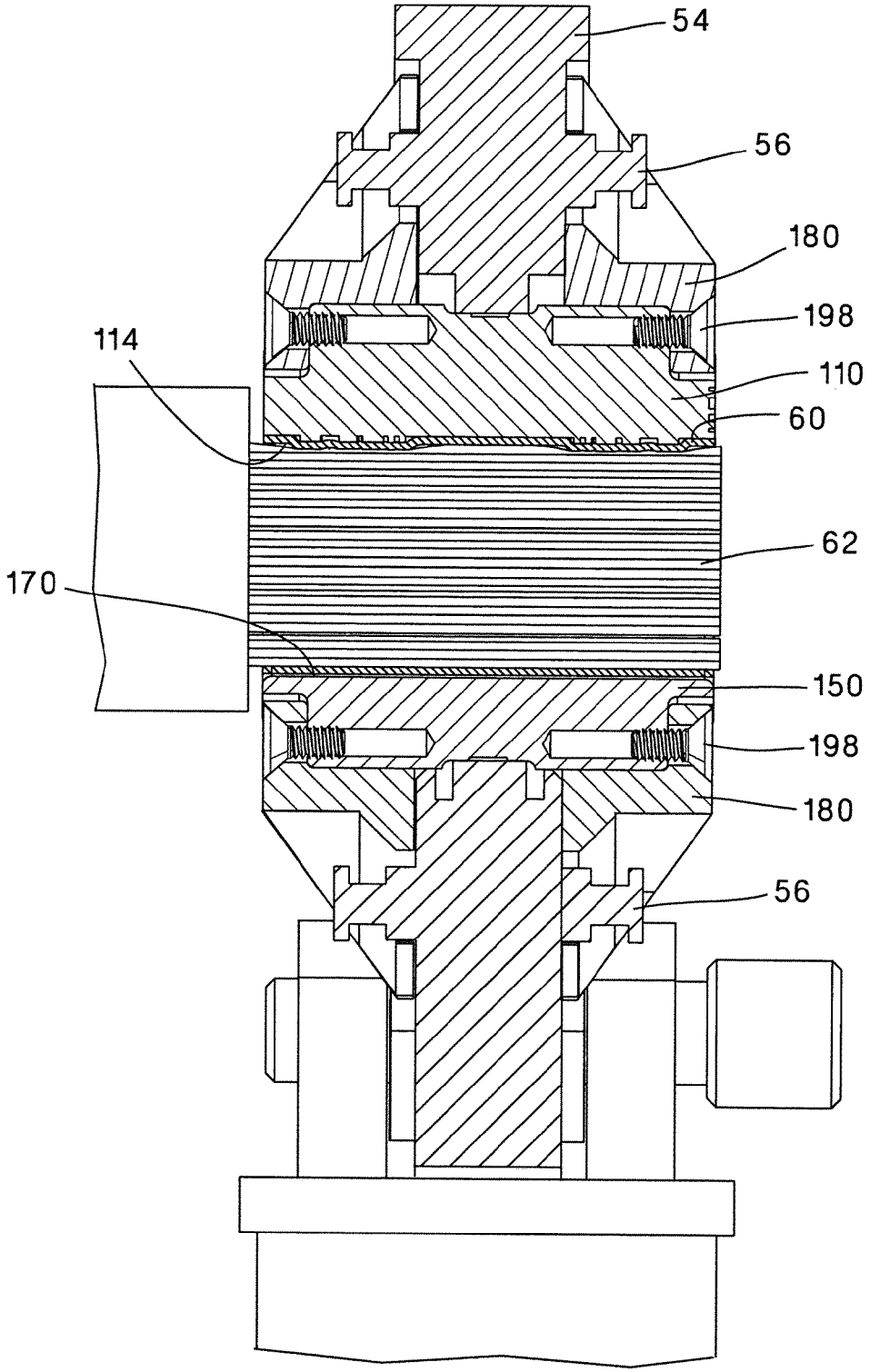
FIG. 10 illustrates a cross sectional view of the large ferrule crimp die and the tool taken along line 10-10 of FIG. 7.
Figure 11:
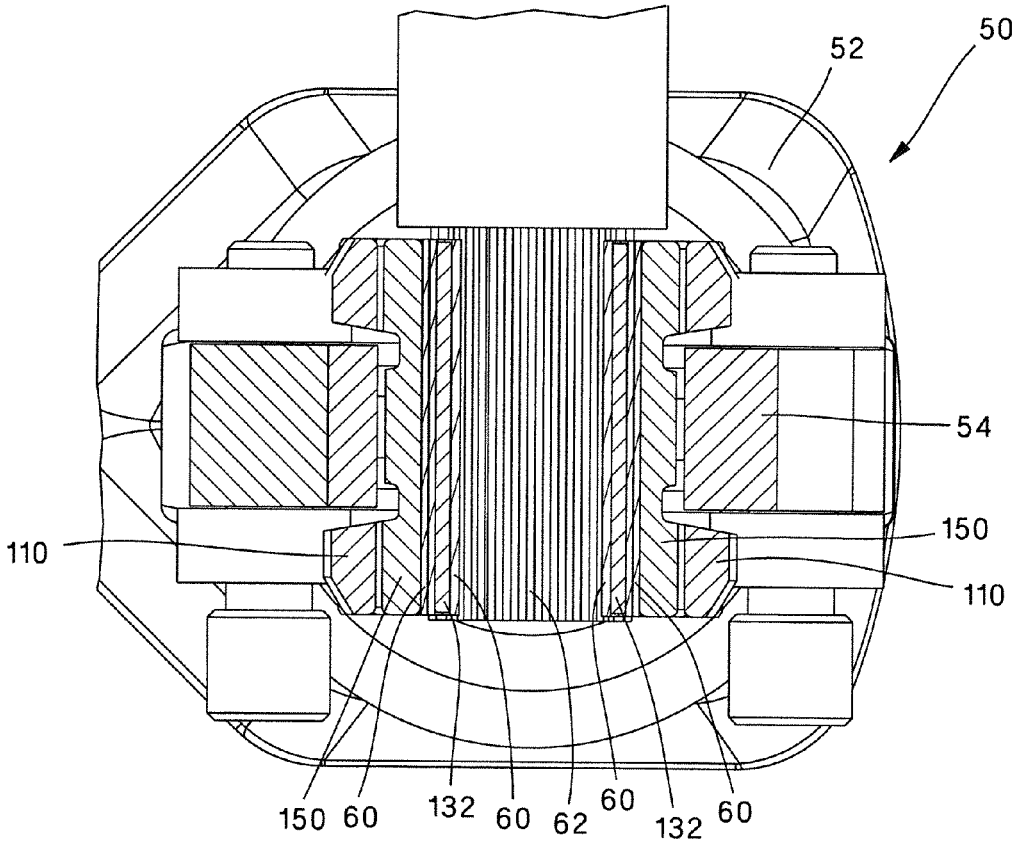
FIG. 11 illustrates a cross sectional view taken along line 11-11 of FIG. 7.

As illustrated in FIGS. 6-11, the tab adapters 180 are fastened to the male die 110 and the female die 150 via the fastener 198. The mounting portions 190 of the tab adapters 180 are secured to the pins 56 in the tool head 54 to secure the male die 110 and the female die 150 to the crimping tool 50. FIG. 8 illustrates the male die 110 and the female die 150 positioned within the tool head 54 such that the tool head 54 is located in the sides 120, 160 of the male die 110 and the female die 150, respectively.

Figure 12:
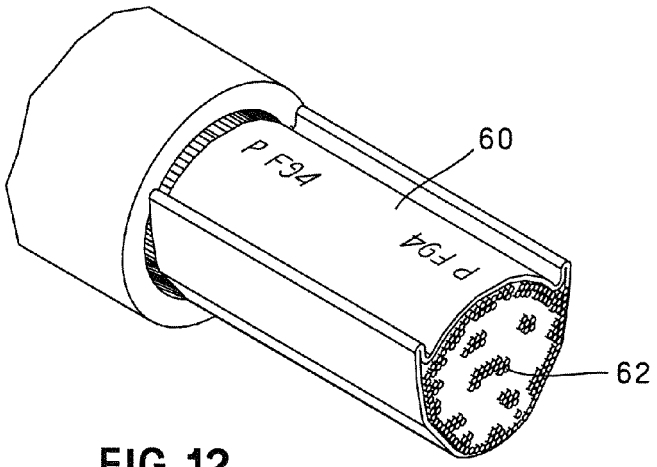
FIG. 12 illustrates a perspective view of the ferrule crimped by the large ferrule crimp die of FIG. 1.

A large ferrule 60 with cables 62 positioned therein is placed between the male die 110 and the female die 150 installed in the crimping tool 50. When the crimping tool 50 is activated, the male die 110 and the female die 150 deform the large ferrule 60 and cables 62 to the shape of the profiles of the inner crimping surfaces 114, 154 of the male die 110 and the female die 150 (see FIG. 12). FIG. 12 also illustrates the crimped ferrule with an imprinting of the size of the die on the ferrule.

Figure 13:
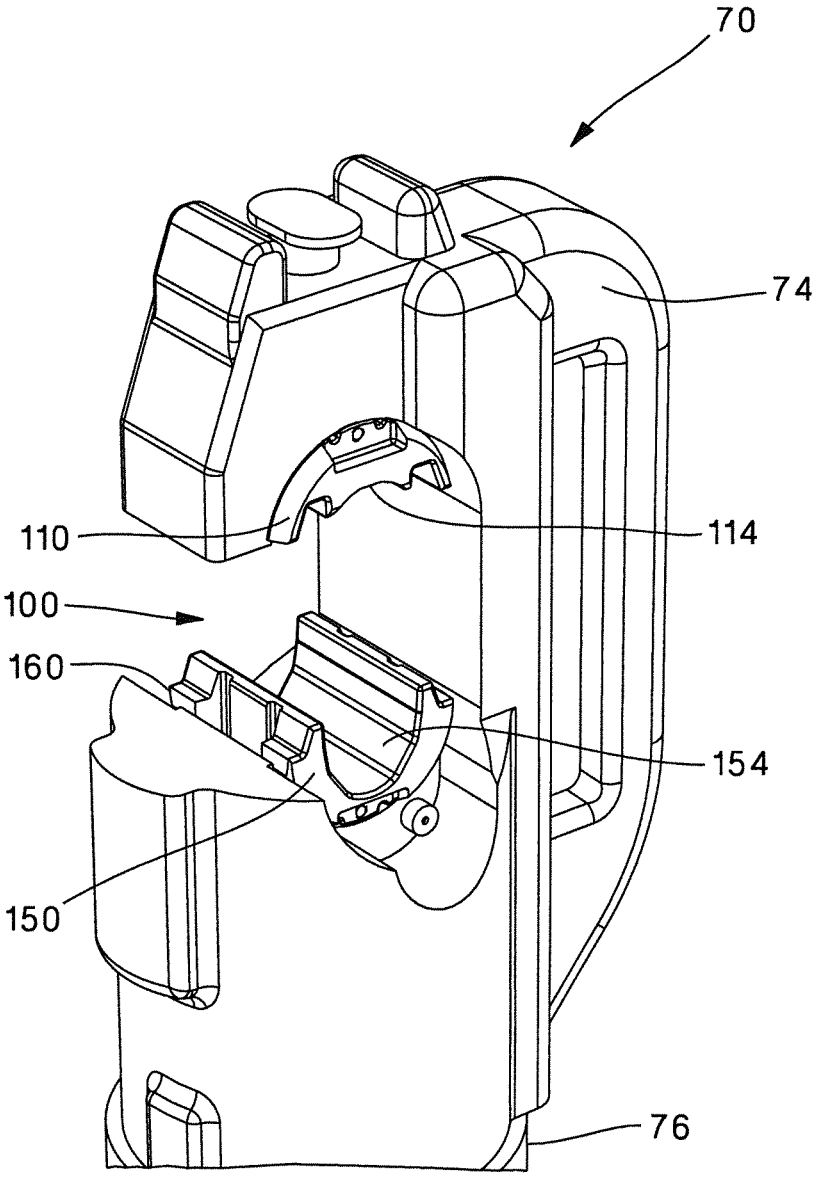
FIG. 13 illustrates a perspective view of the large ferrule crimp die of FIG. 1 installed in an alternative crimping tool.
Figure 14:
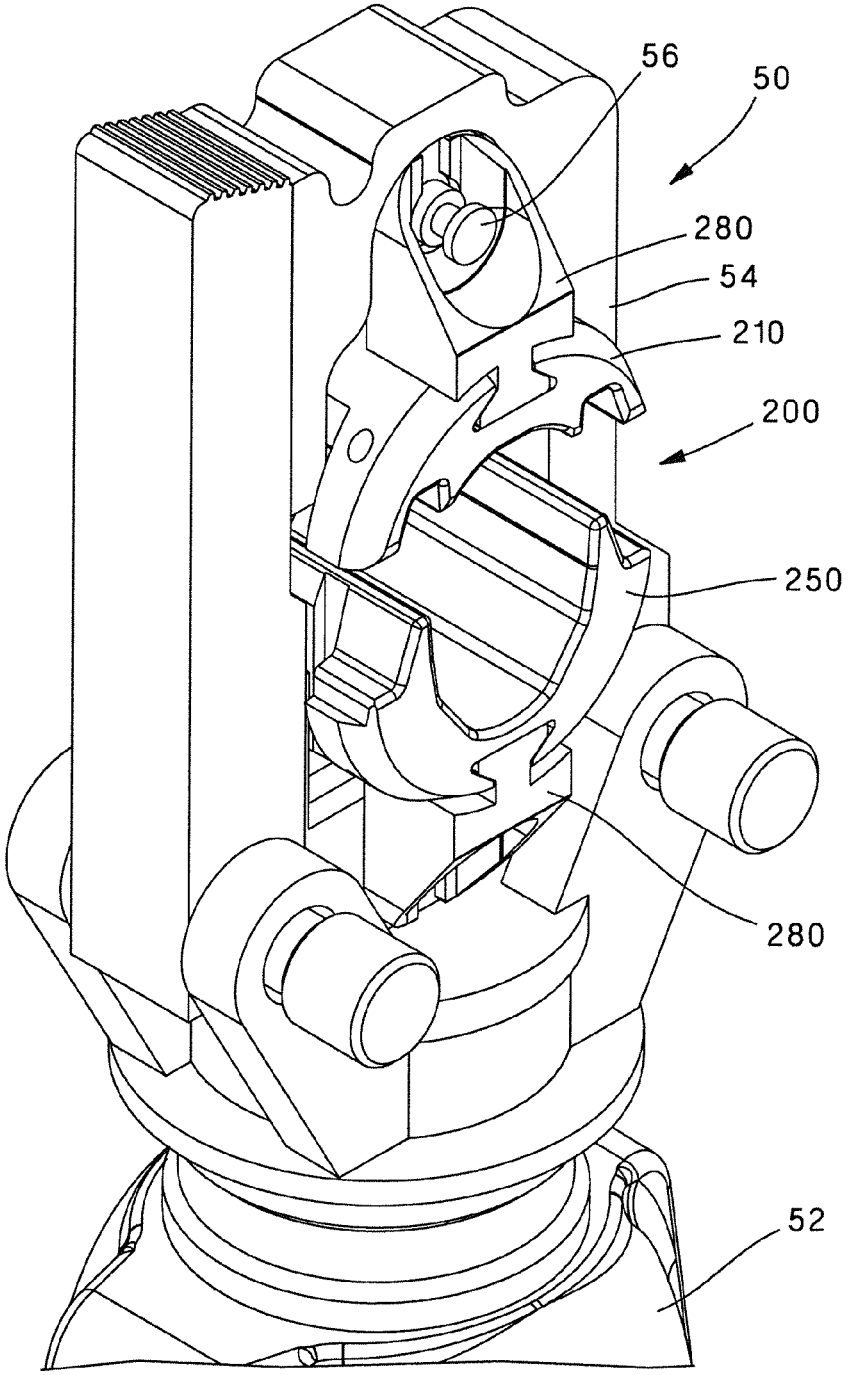
FIG. 14 illustrates a perspective view of an alternative embodiment of a large ferrule crimp die installed in the crimping tool of FIG. 1.

FIG. 13 illustrates the large ferrule crimp die 100 installed in an alternative crimping tool 70. The alternative crimping tool 70 is sold by Panduit Corp., assignee of the present invention, with a CT-900 series tool head. This style crimping tool is used for higher volume crimping applications. As illustrated, the tab adapters 180 have been removed and the male die 110 and female die 150 are directly secured to the crimping tool 70.

FIGS. 14-17 illustrate an alternative embodiment of a large ferrule crimp die 200 installed in the crimping tool 50. The large ferrule crimp die 200 includes a male die 210, a female die 250, and a plurality of tab adapters 280. The male die 210 includes a mounting portion 212 and an inner crimping surface 214. The mounting portion 212 includes a center groove 213 along the outer side of the male die 210. The inner crimping surface 214 of the male die 210 includes a circular portion 230 that leads to two raised members 232. The mounting portion 212 also includes a front 216 and a back 218 with a dove tail slot 226.

The female die 250 includes a mounting portion 252 and an inner crimping surface 254. The mounting portion 252 includes a center groove 253 along the outer side of the female die 250. The inner crimping surface 254 of the female die 250 includes a curved portion 270 that leads to angled portions 272 and then vertical portions 274. The mounting portion 252 also includes a front 256 and a back 258 with a dove tail slot 266.

Figure 15:
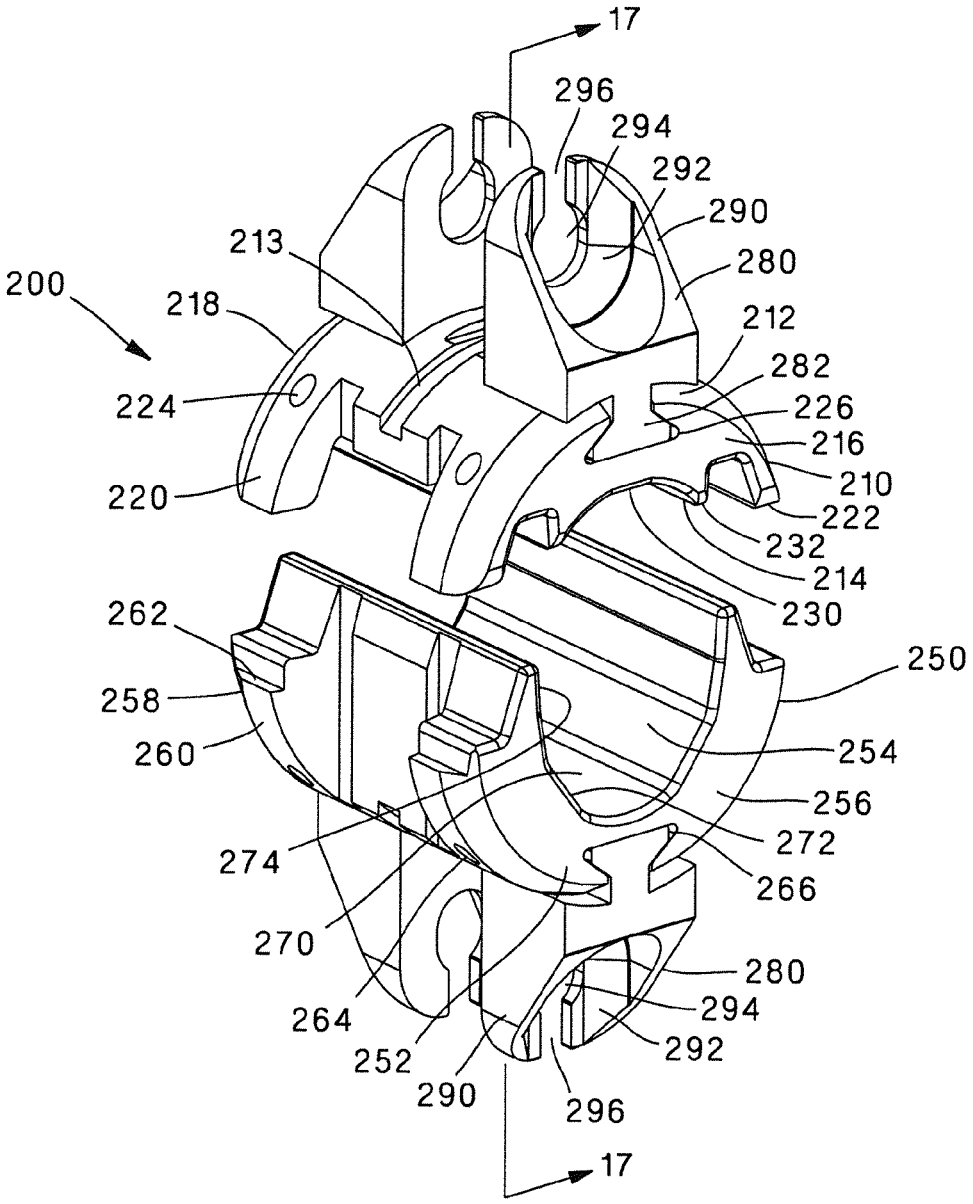
FIG. 15 illustrates a perspective view of the large ferrule crimp die of FIG. 14.
Figure 16:
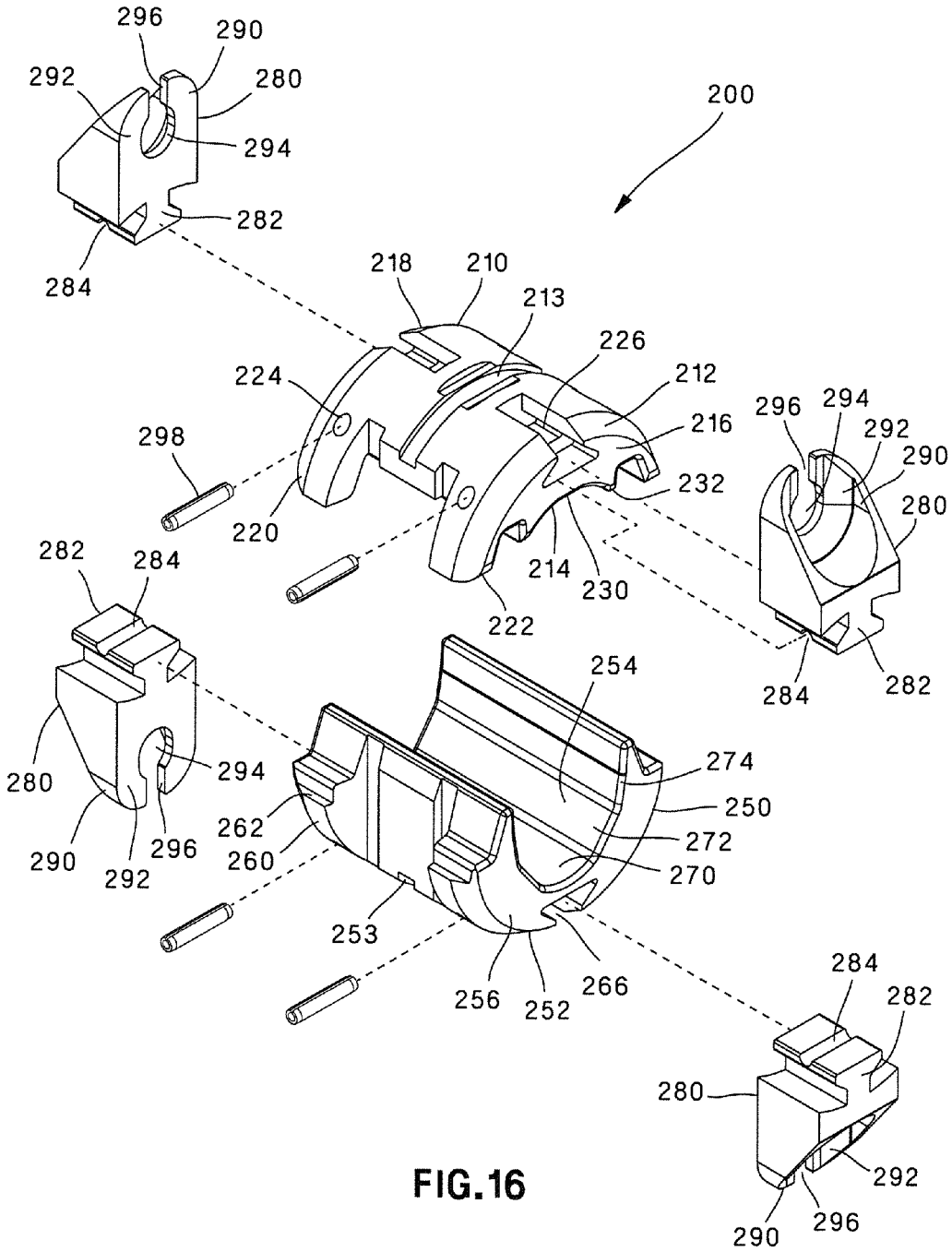
FIG. 16 illustrates an exploded view of the large ferrule crimp die of FIG. 15.

The sides 220, 260 of the male die 210 and the female die 250, respectively, include side edges 222, 262 for receiving the tool head 54. As illustrated in FIGS. 15 and 16, the sides 220, 260 of the male die 210 and the female die 250 also include apertures 224, 264 that extend through the dove tail slots 226, 266 located in the front 216, 256 and back 218, 258 of the dies 210, 250. The apertures 224, 264 are designed to receive a pin 298 to secure a tab adapter 280 to the front 216, 256 and back 218, 258 of each die 210, 250.

Each tab adapter 280 includes a dove tail 282 and a mounting portion 290. As illustrated in FIGS. 14-16 and 18, the dove tail slots 226, 266 are designed to receive the dove tail 282 extending from one of the tab adapters 280. However, the dove tail 282 and the dove tail slot 266 may be formed from other shapes that are complementary to each other.

Figure 17:
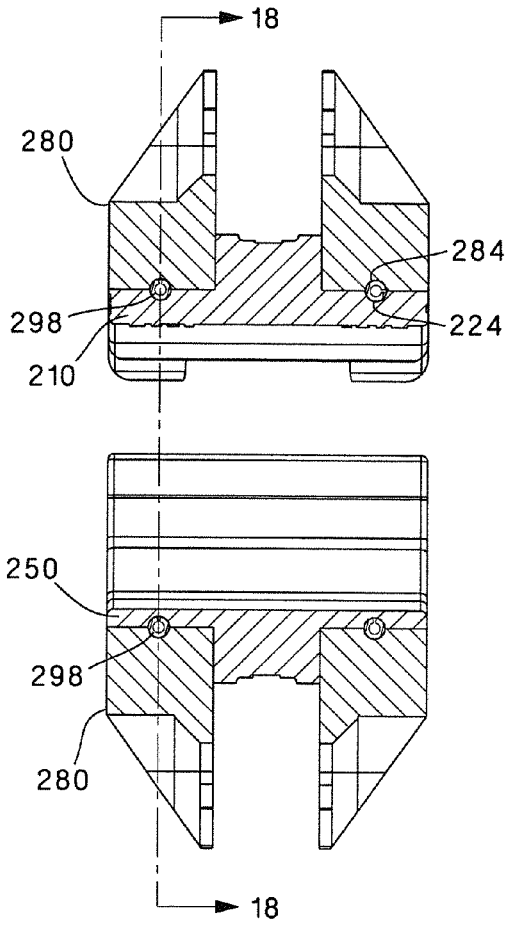
FIG. 17 illustrates a cross sectional view of the large ferrule crimp die taken along line 17-17 of FIG. 15.
Figure 18:
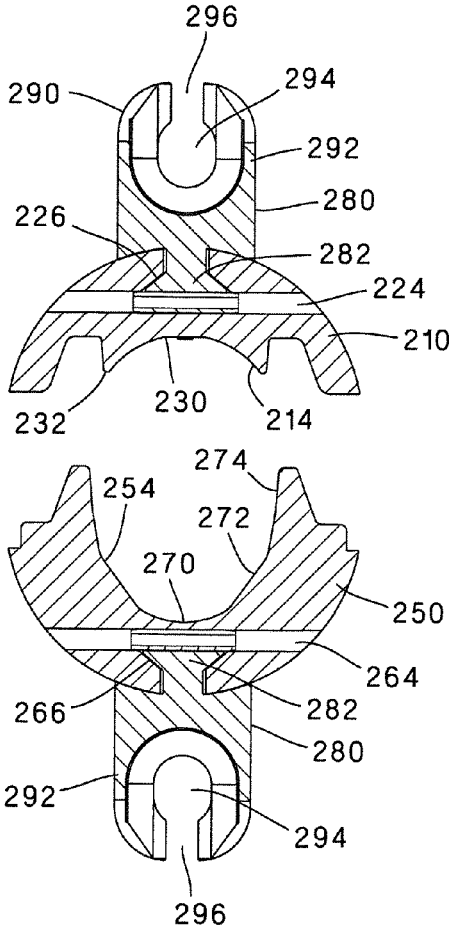
FIG. 18 illustrates a cross sectional view of the large ferrule crimp die taken along line 18-18 of FIG. 17.
Figure 19:
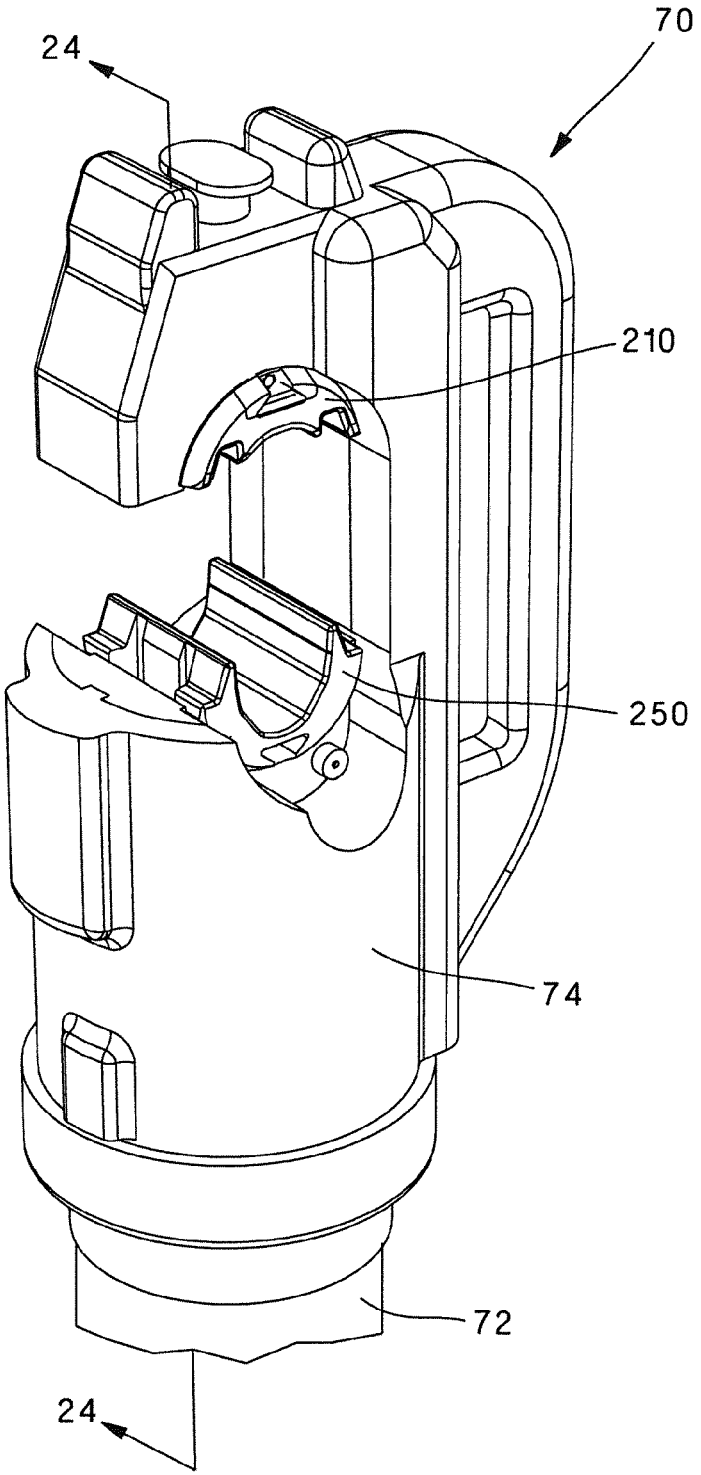
FIG. 19 illustrates a perspective view of the large ferrule crimp die of FIG. 14 installed in the alternative crimping tool of FIG. 13.
Figure 20:
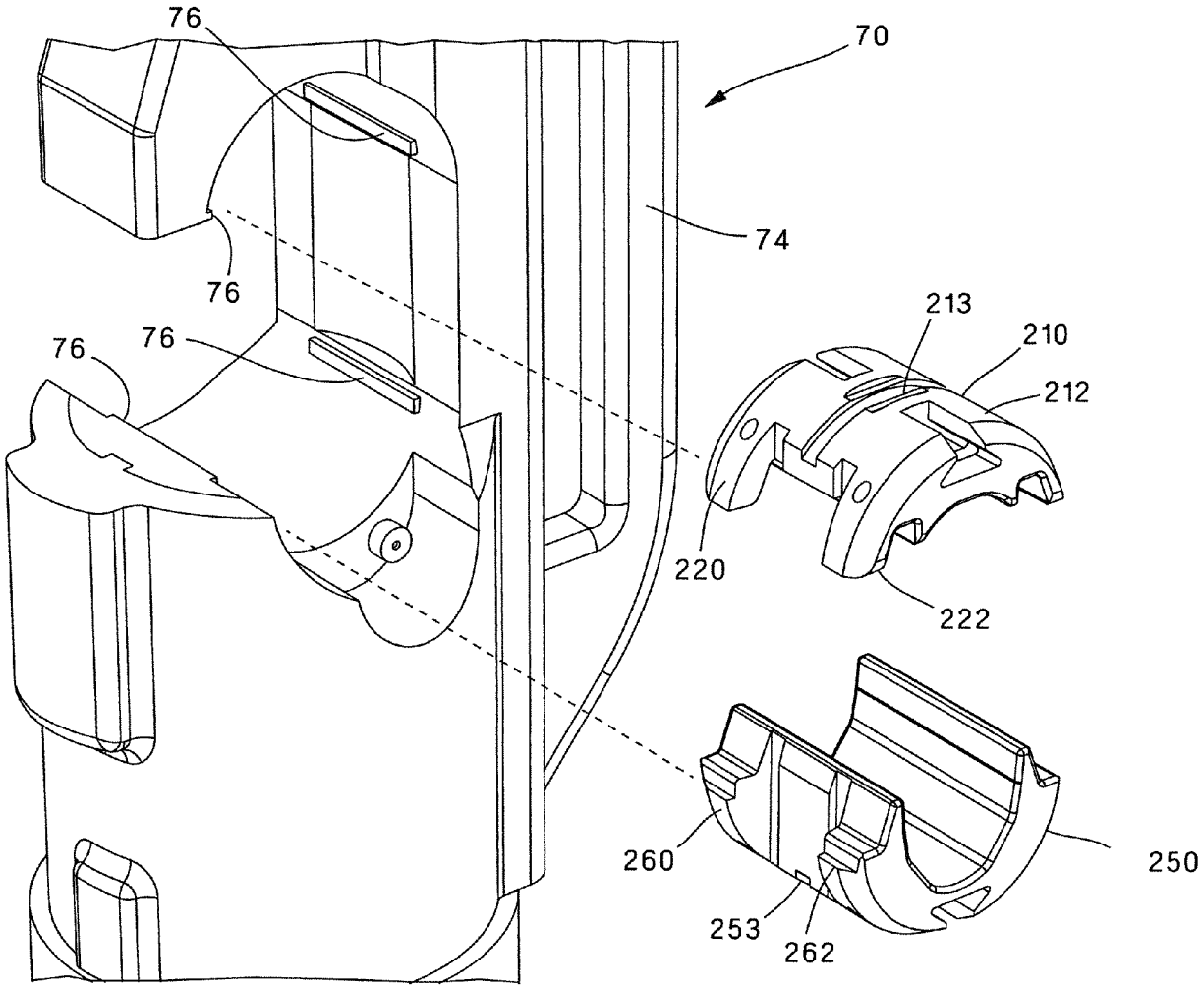
FIG. 20 illustrates a partially exploded left perspective view of the large ferrule crimp die positioned to be installed in the tool of FIG. 19.
Figure 21:
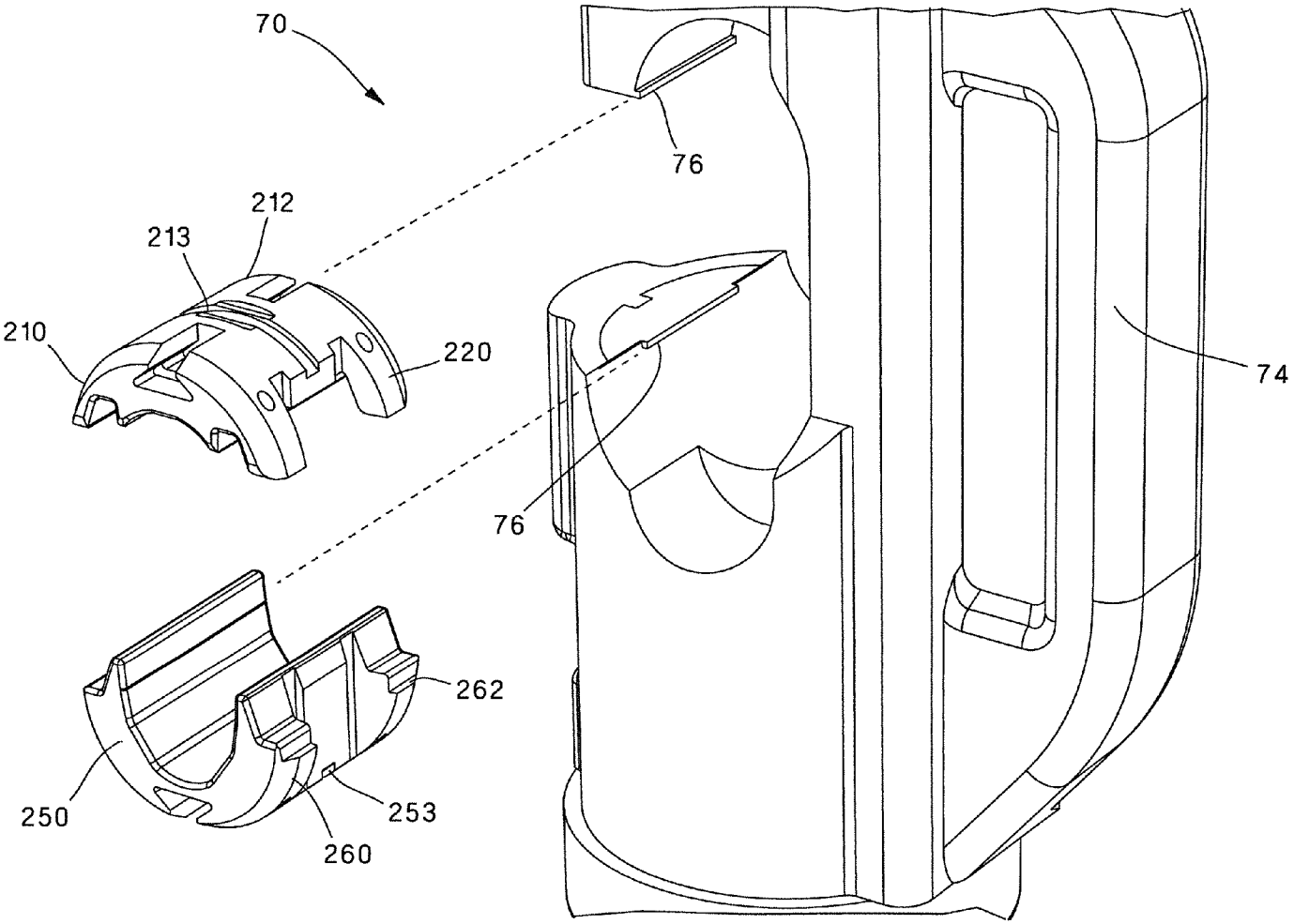
FIG. 21 illustrates a partially exploded right perspective view of the large ferrule crimp die positioned to be installed in the tool of FIG. 19.
Figure 22:
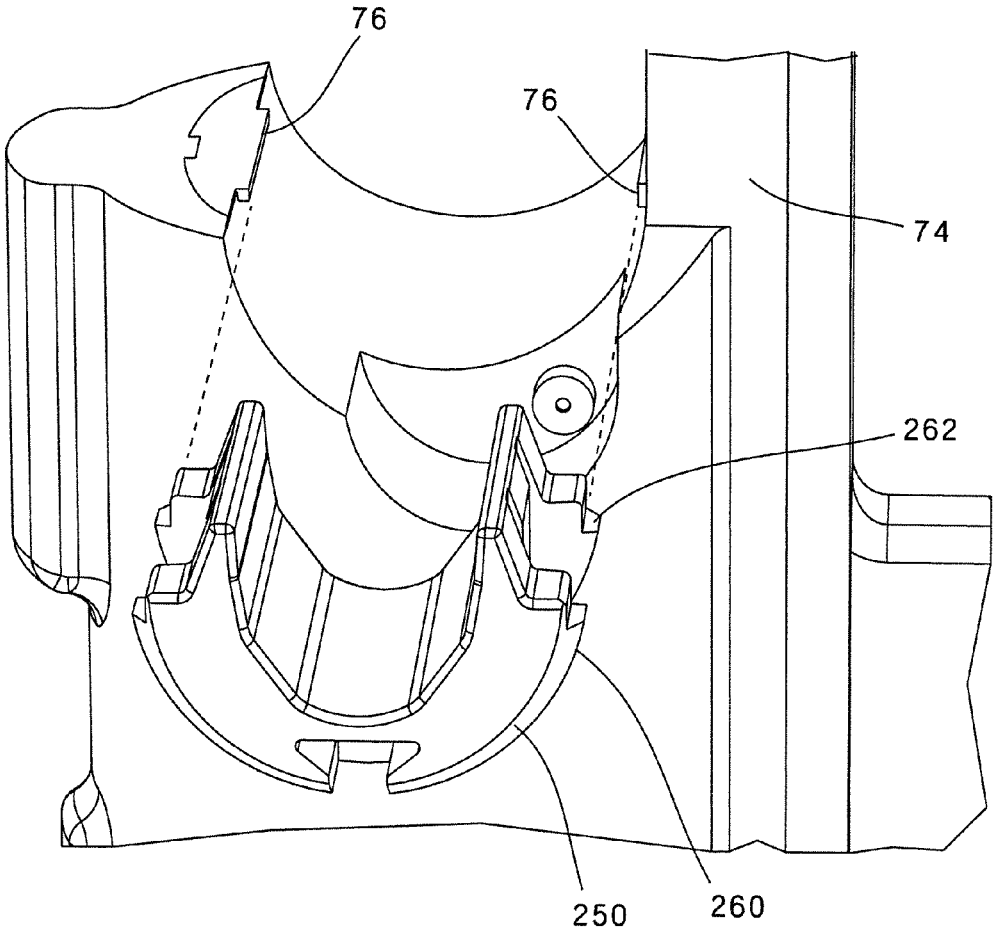
FIG. 22 illustrates the female die of the large ferrule crimp die positioned to be installed in the tool of FIG. 19.
Figure 23:
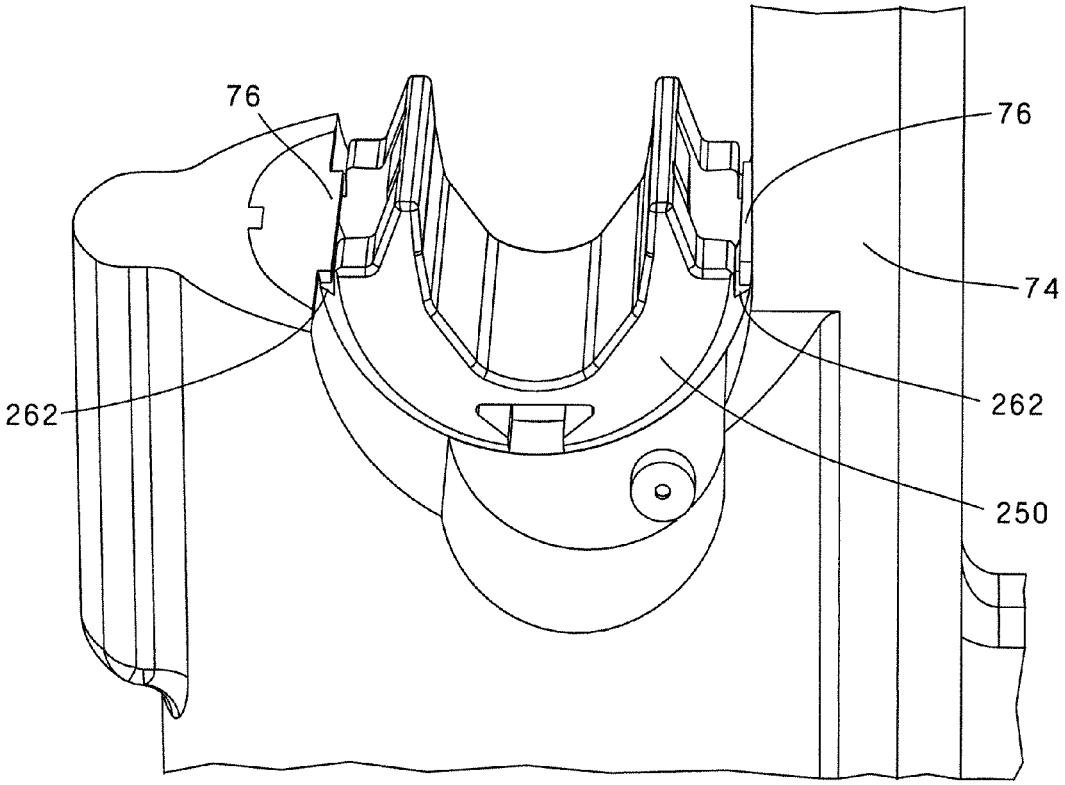
FIG. 23 illustrates the female die of the large ferrule crimp die installed in the tool of FIG. 19.
Figure 24:
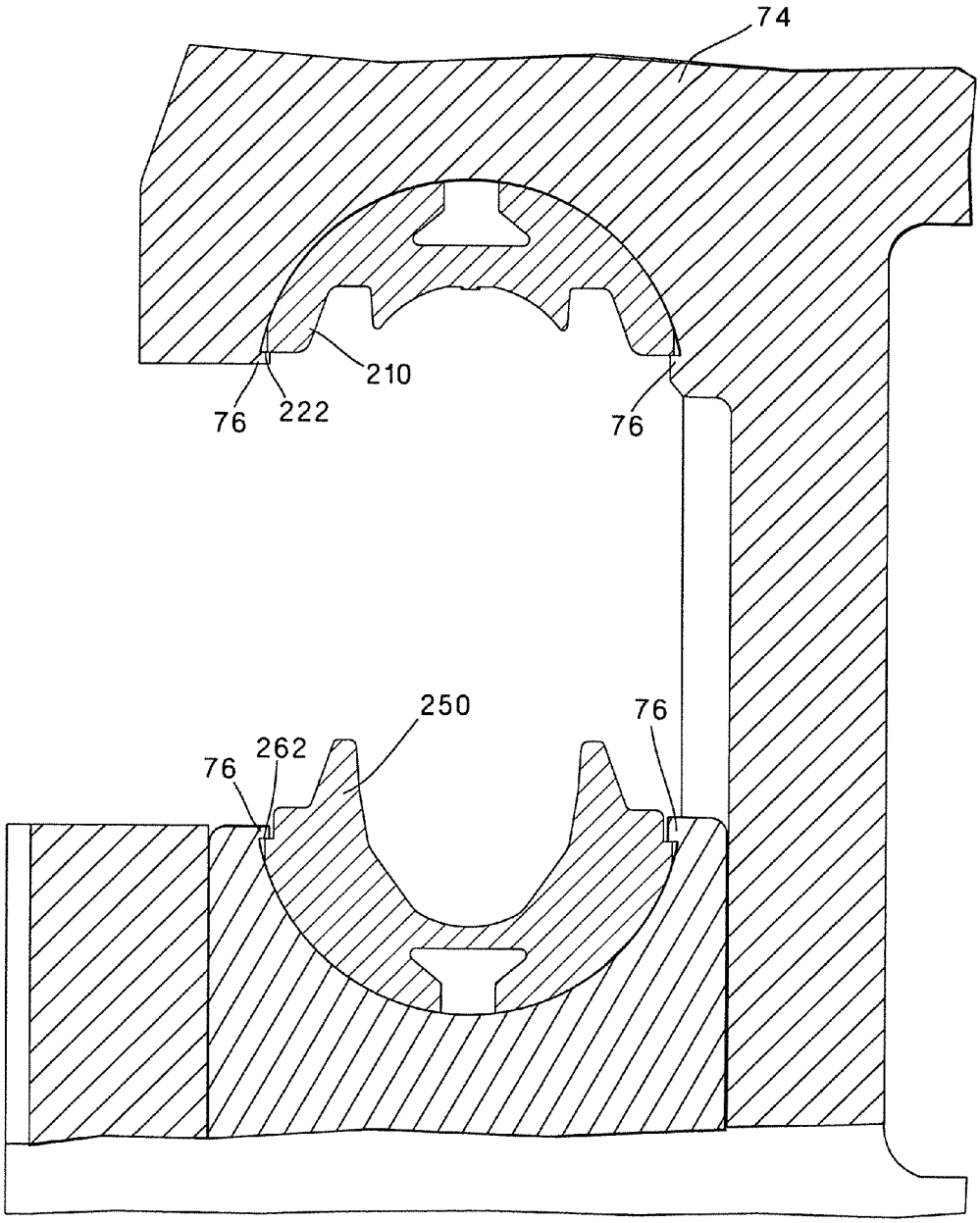
FIG. 24 illustrates a cross sectional view of the large ferrule crimp die taken along line 24-24 of FIG. 19.

Each dove tail 282 includes a groove 284 or indentation for receiving the pin 298. As illustrated in FIG. 17, the pins 298 are installed through the apertures 224, 264 and in the grooves 284 of the dove tail 282 to secure the tab adapters 280 to the dies 210, 250.

Similar to the tab adapters 180 described above, the mounting portion 290 of the tab adapter 280 secures the tab adapter 280 and attached dies 210, 250 to the crimping tool 50. Each mounting portion 290 includes two legs 292 with a center opening 294 or aperture therebetween. The opening 294 is designed with a narrow entrance end 296 for enabling the tab adapter 280 to snap onto the pins 56 on the crimping tool 50.

FIGS. 19-24 illustrate the large ferrule crimp die 200 installed in the crimping tool 70. The tool head 74 includes inwardly extending lips 76. The male die 210 and female die 250 are installed in the tool head 74 such that the lips 76 engage the side edges 222, 262 to prevent the dies 210, 250 from rotating within the crimping tool 70. Additionally, the grooves 213, 253 along the outer surface of the male and female dies 210, 250 are designed to receive a spring loaded pin in the tool head (not illustrated) for holding the dies 210, 250 within the tool. As a result, the tab adapters 280 are not required to mount the dies 210, 250 in the crimping tool 70.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A crimp die for crimping a ferrule onto a cable, the crimp die comprising:

a male die having a mounting portion and an inner crimping surface;

a female die having a mounting portion and an inner crimping surface;

at least one tab adapter removably affixed to at least one of the male die and the female die;

wherein the mounting portion of the male die having a front and a back with an opening for receiving the at least one tab adapter; and wherein the mounting portion of the female die having a front and a back with an opening for receiving the at least one tab adapter;

whereby the male die and the female die deform the ferrule onto the cable.

2. The crimp die of claim 1, wherein each opening is a rectangular pocket having grooves and a center hole.

3. The crimp die of claim 2, wherein the at least one tab adapter having a bottom portion with extrusions, wherein the bottom portion is positioned in the pocket and the extrusions are positioned in the grooves of at least one of the male die and the female die to prevent the tab adapter from rotating.

4. The crimp die of claim 2, wherein the tab adapter having a bottom portion with a center hole, wherein the center hole in the bottom portion aligns with the center hole in the pocket for receiving a fastener to secure the tab adapter the crimp die.

5. The crimp die of claim 1, wherein each opening is a dovetail slot.

6. The crimp die of claim 5, wherein the at least one tab adapter having a dove tail, wherein the dove tail is positioned in one of the dove tail slots to affix the tab adapter to the crimp die.

7. The crimp die of claim 6, further comprising pins extending through the male and female dies to secure the at least one tab adapter in the dove tail slot.

8. The crimp die of claim 7, wherein sides of the male and female dies having an aperture therethrough for receiving the pins.

9. The crimp die of claim 7, wherein the dove tail having a groove for receiving the pin.

10. The crimp die of claim 1, wherein the at least one tab adapter having a mounting portion, the mounting portion having legs that define a center opening with a narrow entrance end, whereby the narrow entrance end is secured to a crimp tool.

11. The crimp die of claim 1, wherein the mounting portion of the male die further comprising a groove extending along an outer surface of the male die; and the mounting portion of the female die further comprising a groove extending along an outer surface of the female die.

12. The crimp die of claim 1, wherein the male and female dies each having sides with a side edge for engaging a crimping tool.

13. A crimp die for crimping a ferrule onto a cable, the crimp die comprising:

a male die having a mounting portion and an inner crimping surface;

a female die having a mounting portion and an inner crimping surface;

at least one tab adapter removably affixed to at least one of the male die and the female die;

wherein the mounting portion of the male die further comprising a groove extending along an outer surface of the male die; and wherein the mounting portion of the female die further comprising a groove extending along an outer surface of the female die; whereby the male die and the female die deform the ferrule onto the cable.

* * * * *